United States Patent [19]

Zurawin

[11] 4,182,455

[45] Jan. 8, 1980

[54] CONTAINER RACK

[75] Inventor: Adam Zurawin, New York, N.Y.

[73] Assignee: Adams Brush Mfg. Co., Inc., Brooklyn, N.Y.

[21] Appl. No.: 851,869

[22] Filed: Nov. 16, 1977

[51] Int. Cl.[2] ..... A47F 5/08; A47G 29/00

[52] U.S. Cl. ..... 211/71; 211/69.8; 211/89

[58] Field of Search ..... 211/71, 72, 73, 60, 211/120, 134, 126, 74, 89, 69.8; 108/55.1, 55.3, 901; 214/10.5 R

[56] References Cited

U.S. PATENT DOCUMENTS

| | | | |
|---|---|---|---|
| D. 245,299 | 8/1977 | Beck | D6/04 |
| 1,841,370 | 1/1932 | Grigsby | 52/392 |
| 2,431,589 | 11/1947 | Shuler, Jr. | 108/55.3 X |
| 2,903,139 | 9/1959 | Penman | 211/60 A |
| 3,503,518 | 3/1970 | Black | 211/60 G |
| 3,590,752 | 7/1971 | De Pew | 211/60 R |

FOREIGN PATENT DOCUMENTS

| | | | |
|---|---|---|---|
| 2268702 | 11/1975 | France | 108/55.1 |

*Primary Examiner*—Ramon S. Britts

*Attorney, Agent, or Firm*—Hubbell, Cohen, Stiefel & Gross

[57] ABSTRACT

A hollow-molded rack is provided for displaying and dispensing containers. The rack can be wall mounted alone or in close alignment with other like racks. The rack is especially suitable for mounting a collection of empty or full beverage food and parts holding cans.

3 Claims, 4 Drawing Figures

CONTAINER RACK

BACKGROUND OF THE DISCLOSURE

1. Field of the Invention

This invention relates generally to racks, and more particularly to a hollow-molded rack for displaying, storing and dispensing a number of containers.

2. Prior Art

Beverage can display racks have become popular recently, especially among those who are seeking to amass a large collection of the many different brands of soda cans or other metal beverage cans now widely sold.

A known prior beverage can rack which is intended for displaying a collection of emptied cans is produced by Classic Products Incorporated, Chicago, Ill., the prior rack being molded from a single sheet of plastic material. The known rack includes a number of projecting arcuate surfaces, these surfaces conforming to the cylindrical outer surfaces of the cans to be displayed and being formed to extend substantially less than halfway around each of the cans.

Thus, when using the known display rack, it is required to securely fasten each of the displayed cans to the molded sheet by way of separate adhesive layers such as, for example, glue or double sided adhesive tape. This requirement detracts from the usefulness of the rack as a means for mounting a collection of full or emptied beverage cans, some of which are to be later removed for purposes of using or trading or other disposition. It will be appreciated that it is desirable not to damage the collections or to leave traces of glue or tape on the surfaces of the cans or on the display rack itself when the cans are removed therefrom.

It is also known in the prior art to secure a container to a dispensing rack by way of protruding arms which hold the container by being inserted under a lip or edge formed on the container body. Such structures are disclosed in U.S. Pat. No. 2,508,945 and U.S. Pat. No. 3,552,612. However, these patented racks will not hold containers which are not provided with lips or reentrant portions, and they are not formed by hollow-molding a single plastic sheet. Thus, such patented racks cannot be used with several types of cans nor do they possess other advantages as explained later below.

Further, holding and supporting means for securing a number of pharmaceutical phials or ampules is known in which a number of such ampules, each having a smooth body, are clamped to a resilient strip. In particular, U.S. Pat. No. 2,598,492 shows and describes various embodiments of such holding means. FIG. 7 of that patent illustrates an embodiment in which a suitably elastic strip is formed with cylindrical corrugations, the corrugations defining a series of phial receiving collars having restricted openings at the tops thereof, according to the patent. As is the case with the other patented dispensing racks discussed above, the phial holding means disclosed in U.S. Pat. No. 2,598,492 are not formed from a hollow-molded plastic sheet and, further, there is no suggestion in any of the known prior art of a container dispensing rack comprising such a hollow-molded sheet.

The above and other shortcomings in the prior art are overcome by the present invention.

SUMMARY OF THE INVENTION

The present rack comprises a unitary hollow-molded plastic sheet having a plurality of outward projections defining regions between adjacent projections which are substantially arcuate and of angular extent greater than 180°. These regions are contoured to partially surround the bodies of the containers to be displayed or dispensed. The defined arcuate regions have a diameter which is preferably no greater than that of the containers to be mounted. Thus, the containers can be force fitted into the defined regions and securely held therein by virtue of the projections (undercuts) which surround the containers more than 180° and which act to clamp them in place.

The present rack is hollow-molded, preferably by vacuum forming a sheet of heated plastic material such as, for example, high impact styrene, the material preferably being rubberized. The molded display rack is preferably molded with an "assist" of a wood "plug" which helps in molding before the molded sheet reaches room temperature so as to avoid breaking or rupturing of the molded sheet when it is separated from corresponding projections on the mold.

The container rack of the present invention can therefore be produced inexpensively and, nevertheless, provide great utility.

DETAILED DESCRIPTION OF THE INVENTION

Figure 1:
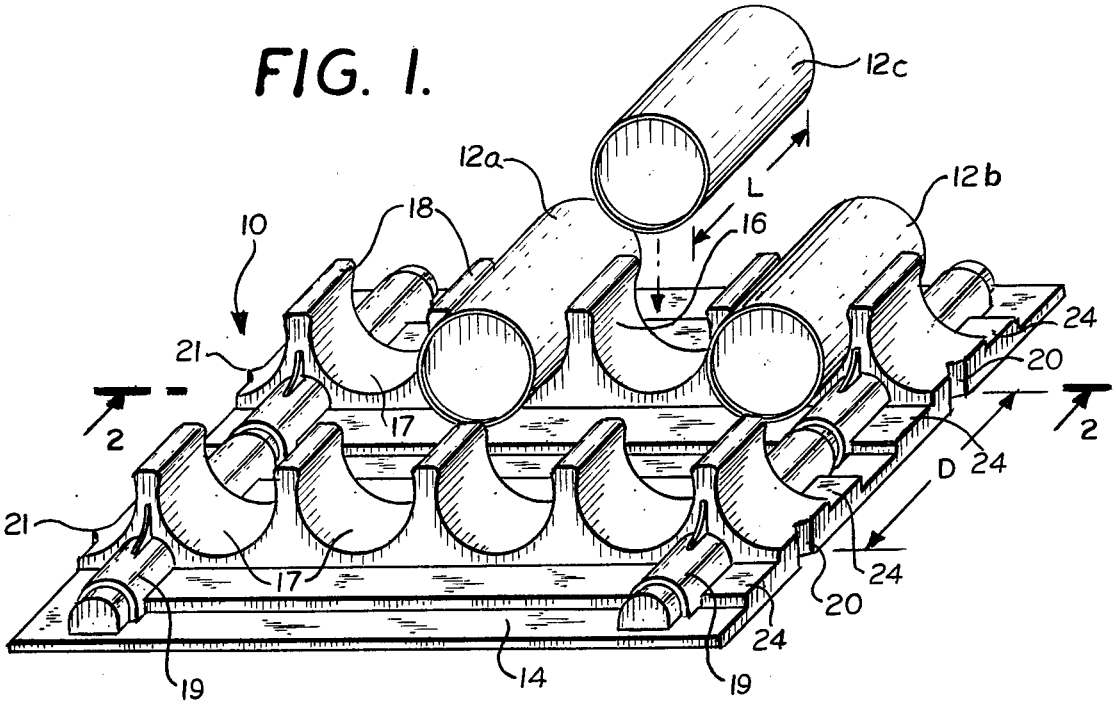
FIG. 1 is a perspective view of a molded container rack according to the present invention.
Figure 2:
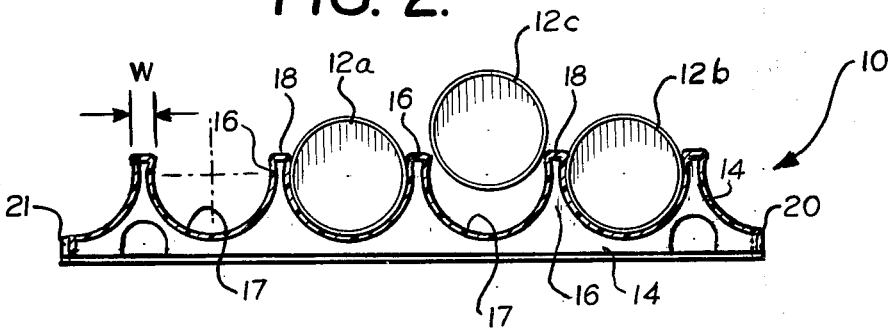
FIG. 2 is a sectional view, taken along line 2—2 in FIG. 1.

Referring in detail to the drawing and initially to FIGS. 1 and 2 thereof, designated generally by numeral 10 is a container rack according to the present invention.

Rack 10 comprises a plurality of rows of spaced apart projections 16 which define, between opposed surfaces of adjacent pairs of the projections, arcuate regions 17. For reasons which will become apparent hereinafter, the angular extent of the arcuate regions 17 is slightly greater than 180°.

The diameter of the arcuate regions 17 is preferably substantially equal to and no greater than the diameter of the cans to be displayed, that is, cans 12*a*, 12*b* and 12*c*.

The rows of projections 16 are spaced apart from one another by a given distance D. It will be apparent that the distance D should preferably be equal to or greater than the overall lengths L of cans 12*a*, 12*b* and 12*c* so that a number of such cans, when displayed in vertical alignment on the rack 10 (not shown), may each be disposed between respective pairs of vertically aligned projections 16.

The rack 10 is formed from a single sheet 14 of resilient plastic material having sufficient thickness to maintain its sturdiness after it is heated, molded and cooled to form the rack 10, as explained below. A preferred material for the sheet 14 is 50 mil, rubberized high impact styrene (H.I.S.).

The sheet 14 is preferably hollow-molded, for example, by a conventional in line vacuum forming machine, and thereafter removed as by a conventional wood assist as detailed later with regard to FIGS. 3 and 3A. Further, the resiliency of the molded sheet 14 allows for the cans to be securely clamped between selected pairs of the projections 16 when the cans are placed therebetween by a user.

As shown in the drawing, the outer extremity of each of the projections 16 comprises a widened portion 18 which extends above the narrowest portion or neck of each of the projections 16. These widened portions 18 act to define the extremities of the regions 17 so that the regions 17 extend arcuately a sufficient amount over 180° to securely clamp the mounted cans 12*a* and 12*b*, and to hold them stationary when the cans are vertically oriented without the need for any adhesive material. When forming the above preferred styrene sheet material, it has been found that an arc of about 190° is sufficient for the regions 17 when the outer overall width W of widened portions 18 is about 0.375 inches (0.953 cm).

It would appear that there would be a problem in removing the molded rack 14 from its mold 22 due to the fact the the projections 18' of the mold are wider than the narrow throats of the projections 16 on the rack. This problem is solved by the selection of a sheet material which has sufficient resiliency to elastically deform during removal so that the throat portion of the projections 16 stretch to accommodate the passage of the widened portions 18' of the molds past the narrow throats of projections 16. After passage is completed, due to the inherent resiliency of the rubberized polystyrene sheet, the material in projections 16 will snap back to its illustrated shape. Clearly, the removal of the sheet must be accomplished after it has been cooled sufficiently to resist plastic deformation. Such plastic deformation would destroy the arcuate contour so necessary in the defined article to hold cans 12 without the use of adhesive. While air cooling may be employed for this purpose, it is preferred that after the rack is fully formed on the mold a cool water spray is directed at the rack in order to cool it below its softening point and to restore it to an elastic condition. After achieving this, the molded rack is removed from the mold 22, a conventional wood assist being employed to eject the rack from the mold.

The molded sheet 14 also preferably includes a number of transverse or vertical strengthening ribs 19 formed thereon to provide additional overall rigidity to the rack 10, and a number of longitudinal or horizontal ribs 24. As shown, ribs 19 are semi-cylindrical whereas ribs 24 are rectangular in cross-section. However, the particular forms selected for the ribs 19 and 24, and their orientation across the rack 10, will be apparent to a worker skilled in the art and, being conventional, need not be further described in detail.

The container rack 10 of the present invention can be mounted closely adjacent another like container rack (unshown) by way of recesses 20 formed along one edge of the rack 10 for engaging complimentary protrusions 21 disposed at corresponding locations along the opposite side of the rack 10. Thus, when the protrusions 21 on one of the present racks engage the recesses 20 along one side of the other rack, both of the present racks can thereby be properly aligned with respect to one another. Of course, further racks may be brought in alignment with the two racks so aligned, as desired.

FIG. 2 is a view of the present rack 10 taken along line 2—2 in FIG. 1 and shows can 12*c* brought more closely to the rack 10 for mounting thereon. FIG. 2 clearly illustrates the projections 16 and the regions 17 formed therebetween from the sheet 14.

The overall width W of the widened portions 18 is preferably chosen to allow the can 12*c* to be inserted for display between a pair of projections 16, even though these projections 16 and their associated widened portions 18 are somewhat restrained from outward movement because of the presence of additional display cans 12*a*, 12*b* immediately to the left and right, respectively, of the projections 16. It has been found that sufficient compliance of the widened portions 18 of each of the projections 16 is achieved when the preferred rubberized high impact styrene sheet is vacuum formed as described above, and that a can such as 12*c* may be repeatedly inserted and withdrawn from a display position between a given pair of projections 16 without collapse or other functional damage being imparted to the projections 16 including their widened portions 18, despite the fact that the spacing between confronting widened portions is less than the diameter of the can and thus must be deformed to insert and remove the can.

Figure 3A:
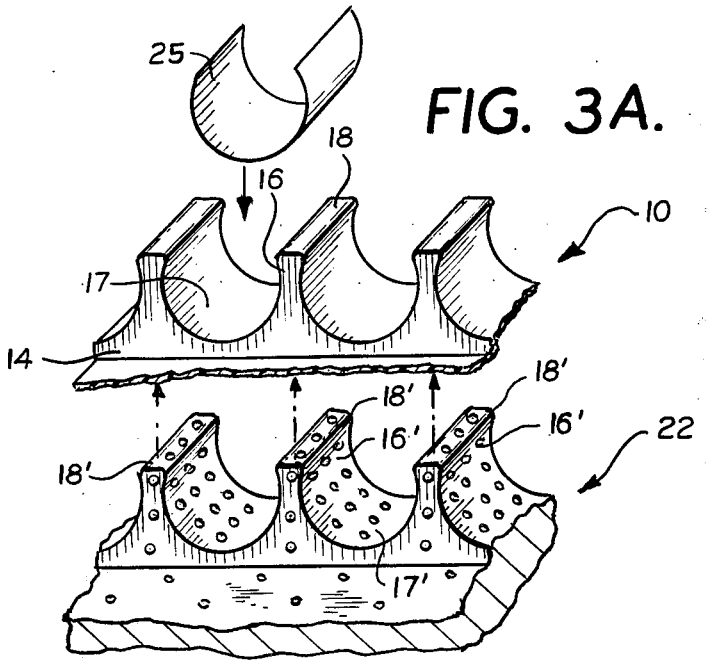
FIG. 3A is an exploded fragmentary view of a portion of the present rack after its removal from the mold.
Figure 3:
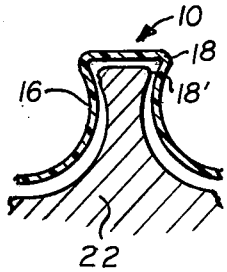
FIG. 3 is a sectional fragmentary view of a portion of the present molded rack before removal of the rack from its mold.

As noted above, to the best of my knowledge, hollow-molding a rack such as the one of the present invention has not heretofore been attempted because of the interlocking encountered when trying to remove the molded piece having widened portions such as 18 from a mold 22 such as shown in FIG. 3.

The molded rack 10 in accordance with the present invention can be mass produced at relatively low cost and, further, will provide a beverage can collector with the convenience of removably holding a collection of such cans, without the necessity for glues or pressure-sensitive adhesives.

While the rack 10 disclosed herein is described as having beverage cans mountable thereon for purposes of illustration, it is to be understood that the rack 10 of the present invention can be used to display and dispense other types of containers as well, including those made from glass and paper, as well as metal. Moreover, such containers may have food sealed therein, the clamping action provided by the projections 16 on the rack 10, and the frictional coefficient provided by the preferred rubberized high impact styrene material for the rack 10, being sufficient to hold such filled containers stationary when the rack 10 is mounted on a kitchen wall or pantry door, for example.

Further, although rack 10 may be initially formed with projections 16 defining arcuate regions 17 for surrounding cans having a predetermined, standard diameter, provisions may be made for securing cans of a lesser diameter as by insertion of plastic shims or inserts 25 against the surfaces of arcuate regions 17 as shown in FIG. 3A. Inserts 25 are preferably formed from the same plastic material as is rack 10, i.e., rubberized high impact styrene and have a thickness and coefficient of friction sufficient to enable the requisite clamping forces to be developed about the small diameter can when one of the inserts 24 partially surrounds the can when mounted between a pair of projections 16. The inserts 25 may, for example, have an adhesive layer on the side thereof which operatively overlies the opposed surfaces of the projections 16, so as to ensure that they remain in place on the rack 10 when cans are not mounted on the rack against the inserts 25.

Variations and modifications of the rack 10 of the present invention in regard to size, proportions, material and forming thereof will be apparent to those skilled in the art. It is therefore intended that all such obvious variations and modifications of the disclosed rack, including those expressly stated herein, and all others be included within the scope of the invention as defined by the appended claims.

What is claimed as new and desired to be secured by Letters Patent is:

1. A container rack for removably mounting a plurality of axially parallel side-by-side cylindrical containers of a particular diameter, said rack comprising a thermoplastic sheet defining a base plane, said sheet including a plurality of projections extending outwardly from said base plane entirely in one direction, said projections having opposed surfaces defining corresponding arcuate regions between adjacent ones of said projections, each of said corresponding arcuate regions having a diameter corresponding to the particular diameter of a container to be mounted on said rack between the opposed surfaces of said adjacent projections, the angular extent of said arcuate regions being an amount greater than 180° sufficient to enable said adjacent projections to elastically deform in response to movement of the selected container therebetween and to enable said adjacent projections to resiliently clamp the selected container in a stationary mounted position between said adjacent projections when the container is vertically oriented on said rack; and an insertable and removable resilient insert strip dimensioned to conform with the opposed surfaces of a given pair of said adjacent projections, the annular extent of said strip being an amount greater than 180°, and said strip being sufficiently thick to enable a container having a particular diameter less than the diameter of the corresponding arcuate region between the given pair of projections to be mounted between said projections when said strip is disposed to overlap said opposed surfaces.

2. A container rack according to claim 1, wherein said plastic sheet comprises rubberized high impact styrene.

3. The container rack of claim 1, wherein said sheet has a peripherally extending side wall, one of the portions of said side wall having projections and another portion of said side wall having recesses complementary to said projections, whereby to enable two like container racks each to be mounted in close side-by-side relation.

* * * * *